US005955995A

United States Patent [19]

Silverstein

[11] Patent Number: 5,955,995

[45] Date of Patent: Sep. 21, 1999

[54] RADIO FREQUENCY ANTENNA AND METHOD OF MANUFACTURE THEREOF

[75] Inventor: Bruce Silverstein, Petach Tikva, Israel

[73] Assignee: Texas Instruments Israel Ltd., Tikva, Israel

[21] Appl. No.: 08/784,625

[22] Filed: Jan. 21, 1997

[51] Int. Cl.[6] ..... H01Q 1/00

[52] U.S. Cl. ..... 343/729; 343/725; 343/727; 343/700 MS

[58] Field of Search ..... 343/700 MS, 702, 343/725, 727, 729, 846; H10Q 1/00

[56] References Cited

U.S. PATENT DOCUMENTS

| | | | |
|---|---|---|---|
| 4,827,266 | 5/1989 | Sato et al. | 343/700 MS |
| 5,515,057 | 5/1996 | Lennen et al. | 343/700 MS |
| 5,594,455 | 1/1997 | Hori et al. | 343/846 |
| 5,650,788 | 7/1997 | Jha | 343/700 MS |
| 5,680,144 | 10/1997 | Sanad | 343/700 MS |

*Primary Examiner*—Hoanganh Le
*Assistant Examiner*—Kimnhung Nguyen
*Attorney, Agent, or Firm*—McDermott, Will & Emery

[57] ABSTRACT

A novel RF antenna and method of manufacture thereof is disclosed. With this novel antenna the energy radiates in all directions including both left hand and right hand polarizations. In one embodiment of the invention, the antenna consists of two equal size rectangularly shaped conductive sheets positioned in parallel with each other. The side dimensions are nearly a half wavelength of the center frequency. The rectangle is nearly a square with one dimension slightly larger than the other. The feed point is at any of the corners. The difference in side dimensions cause the antenna to resonate at two adjacent frequencies, one slightly above the working frequency and the other slightly below. This creates a phase difference between the orthogonal modes of operation at the working frequency. A 90 degree phase difference generates circular polarization. Other embodiments include using circularly shaped conductive plates, placing cutouts in one dimensions of the rectangularly shaped conductive sheets, placing transverse cut outs in the center of the conductive sheets, placing discrete components between the conductive plates and using a phase shift network to generate two feed pints rather than one. Another embodiment discloses an antenna exhibiting polarization diversity. The antenna of this embodiment is constructed with two feed point on adjacent corners.

17 Claims, 5 Drawing Sheets

RADIO FREQUENCY ANTENNA AND METHOD OF MANUFACTURE THEREOF

FIELD OF THE INVENTION

The present invention relates generally to antennas and more particularly relates to radio frequency (RF) parallel plate antennas.

BACKGROUND OF THE INVENTION

The current trend in consumer electronics is to eliminate as many wires and cables as possible. An integral part of any wireless solution to the bulk of cables crowding many homes and offices today is an RF antenna. The environment faced by antennas placed in homes and small offices typically includes many obstacles such as walls and floors. Using vertical polarization, propagation through walls constructed using reinforced concrete tends to be attenuated more than horizontal polarization due to the steel bars placed in the walls. Similarly, vertically polarized radiation propagating through walls constructed using metal studs and sheet rock is also attenuated due to the metal studs. It is therefore desirable to have an RF antenna that is not effected by such obstacles.

SUMMARY OF THE INVENTION

Accordingly, it is an object of the present invention to provide an RF antenna that generates circular polarization and overcomes the disadvantages of prior art antennas.

It is another object of the present invention to provide a low cost RF antenna which is simple to manufacture and which has a relatively high gain for its size.

Another object of the present invention is to provide an RF antenna that is balanced and does not require a ground plane.

The present invention is a circularly polarized parallel plate antenna which radiates circularly polarized radiation in all directions so as to interact with any linearly polarized antenna, e.g., vertical or horizontal. This type of circularly polarized antenna is a robust solution for an environment that has numerous obstacles such as in homes and offices. In these types of environments the RF propagation of vertically polarized energy through walls tends to be attenuated more than horizontally polarized RF energy because of the common use of steel bars in the construction of the walls.

With this particular circularly polarized antenna, the RF energy is radiated to both hemispheres. One hemisphere is right hand circularly polarized (RHCP) and the other hemisphere is left hand circularly polarized (LHCP). These terms are used to describe the rotation of the polarization with RH representing right hand or clockwise and LH representing left hand or counterclockwise. This is in contrast to the typical antenna having one sense of polarization radiating in a particular direction. The circularly polarized antenna of the present invention functions as an omnidirectional radiator with both RH and LH circular polarization.

One application of a circularly polarized antenna is to connect it to a central unit (e.g., a hub) for communicating with portable units which are each fitted with a linearly polarized antenna. The linearly polarized antenna is typically a quarter wavelength element. Using this system there is a constant loss of 3 dB due to polarization mismatch regardless of the orientation of the antennas on the portable units.

The antenna of the present invention has a big advantage over systems that use linear polarization on both sides of the link from the hub to the portable units. An example of this scenario is when the central unit or hub is using a vertically polarized antenna and the portable units are placed in a horizontal position. In this case, a loss in excess of 20 dB may be realized due to the polarization mismatch thus severely degrading the communication link.

The present invention is a circularly polarized RF antenna and method of manufacture thereof. With this novel antenna the energy radiates in all directions including both left hand and right hand polarizations. In one embodiment of the invention, the antenna comprises two equal size rectangularly shaped conductive sheets positioned in parallel with each other. The side dimensions are nearly a half wavelength of the center frequency. The rectangle is nearly a square with one dimension slightly larger than the other. The feed point is at any of the corners. The different side dimensions cause the antenna to resonate at two adjacent frequencies, one slightly above the working frequency and the other slightly below. This creates a phase difference between the orthogonal modes of operation at the working frequency. A 90 degree phase difference generates circular polarization. Other embodiments include using circularly shaped conductive plates, placing cutouts in one dimensions of the rectangularly shaped conductive sheets, placing transverse cut outs in the center of the conductive sheets, placing discrete components between the conductive plates and using a phase shift network to generate two feed points rather than one. Another embodiment discloses an antenna exhibiting polarization diversity. The antenna of this embodiment is constructed with two feed points on adjacent corners.

There is therefore provided in accordance with a preferred embodiment of the present invention an RF antenna having a center frequency and an input signal source, comprising two equal sized rectangularly shaped conductive plates, each conductive plate having the dimensions L1 and L2 which are approximately a half wavelength of the center frequency, the conductive plates positioned substantially parallel at a distance D from each other, the dimension L1 of the conductive plates is slightly larger than the dimension L2, a feed point located at any corner of the conductive plates, the feed point electrically coupled to the input signal source, and wherein the parallel conductive plates resonate in two adjacent frequencies, one slightly above the center frequency and one slightly below the center frequency thereby creating a phase difference between orthogonal modes of operation.

Further, the phase difference is equal to 90 degrees causing the RF antenna to generate circularly polarized RF energy and the distance between the adjacent frequencies is approximately the same as the bandwidth of the mode. In addition, the distance D between the conductive plates is in the range from 0.01 to 0.25 wavelength and the conductive plates are positioned exactly parallel with each other.

Alternatively, the distance D is not constant between the conductive plates but varies to produce a flaring open at the edges of the conductive plates. Further, the conductive plates comprise cutouts in the sides to increase the resonance frequency of the antenna. The conductive plates may comprise transverse slot cut outs to decrease the resonance frequency of the mode of the antenna. In addition, the antenna may further comprise at least one discrete component, such as a capacitor or an inductor, electrically coupled between the conductive plates.

There is also provided in accordance with a preferred embodiment of the present invention an RF antenna having a center frequency and an input signal source, comprising two equal sized rectangularly shaped conductive plates, each the conductive plate having the dimensions L1 and L2 which are approximately a half wavelength of the center frequency, the conductive plates positioned substantially parallel at a distance D from each other, the dimension L1 of the conductive plates is slightly larger than the dimension L2, a first feed point located on a side of the conductive plates having dimension L1, a second feed point located on a side of the conductive plates having dimension L2, a phase shift network having an input and a first output and second output, the input signal source electrically coupled to the input, the first output electrically coupled to the first feed point, the second output electrically coupled to the second feed point, and wherein the parallel conductive plates resonate in two adjacent frequencies, one slightly above and the center frequency and one slightly below the center frequency thereby creating a phase difference between orthogonal modes of operation.

Further, there is provided in accordance with a preferred embodiment of the present invention an RF antenna having a center frequency and an input signal source, comprising two equal sized circularly shaped conductive plates, the conductive plates positioned substantially parallel at a distance D from each other, a feed point located on the perimeter of the conductive plates, the feed point electrically coupled to the input signal source, and wherein the parallel conductive plates resonate in two adjacent frequencies, one slightly above the center frequency and one slightly below the center frequency thereby creating a phase difference between orthogonal modes of operation.

In addition, there is provided in accordance with a preferred embodiment of the present invention an RF antenna having polarization diversity, a center frequency, a first input signal source and a second input signal source, comprising two equal sized rectangularly shaped conductive plates, each the conductive plate having the dimensions L1 and L2 which are approximately a half wavelength of the center frequency, the conductive plates positioned substantially parallel at a distance D from each other, the dimension L1 of the conductive plates is slightly larger than the dimension L2, a first feed point located at a first corner of the conductive plates, the feed point electrically coupled to the first input signal source, a second feed point located al a second corner of the conductive plates, the feed point electrically coupled to the second input signal source, the second corner being adjacent to the first corner, wherein the parallel conductive plates resonate in two adjacent frequencies, one slightly above the center frequency and one slightly below the center frequency thereby creating a phase difference between orthogonal modes of operation, and wherein the first feed point and the second feed point function to create polarization diversity, the first input signal source and the second input source exciting the antenna in substantially the same manner but with opposite senses of circular polarization orthogonal to one another.

BRIEF DESCRIPTION OF THE DRAWINGS

The invention is herein described, by way of example only, with reference to the accompanying drawings wherein.

DETAILED DESCRIPTION OF THE INVENTION

The present invention is a circularly polarized RF antenna and method of manufacture thereof. The circularly polarized RF antenna of the present invention functions as an omnidirectional radiator with both RH and LH circular polarization. With this particular circularly polarized antenna, the RF energy is radiated to both hemispheres. One hemisphere is right hand circularly polarized (RHCP) and the other hemisphere is left hand circularly polarized (LHCP). These terms are used to describe the rotation of the polarization with RH representing right hand or clockwise and LH representing left hand or counterclockwise. This is in contrast to a circularly polarized antenna having one sense of polarization radiating in a particular direction.

Figure 1:
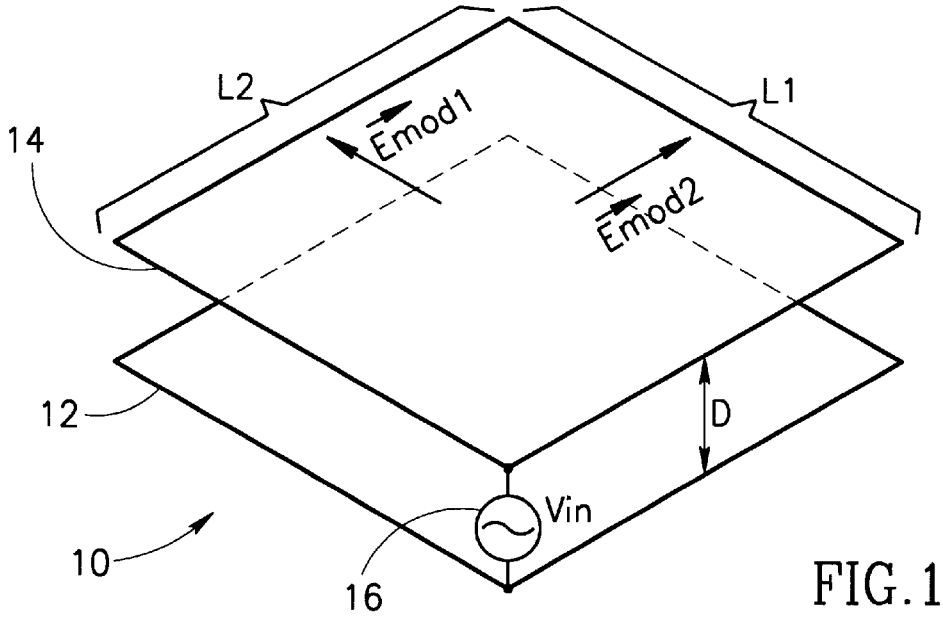
FIG. 1 illustrates a rectangularly shaped antenna constructed in accordance with a preferred embodiment of the present invention.

An illustration of an antenna constructed in accordance with a preferred embodiment of the present invention is shown in FIG. 1. The antenna of the present invention, generally referenced 10, is mainly comprised of two equal size substantially rectangular shaped plates 12, 14 having dimensions L1 by L2 and placed in parallel with each other. The rectangular plates 12, 14 are constructed from conductive sheets. The side dimensions L1, L2 are nearly half a wavelength of the center frequency of the antenna 10. Each rectangularly shaped plate nearly forms a square with one dimension, i.e., L1 or L2, slightly larger than the other. The signal source 16 functions as the input feed source to the antenna. The feed point of the input signal source 16 is at one of the corners of the antenna.

Due to the slightly different side dimensions, the parallel plates 12, 14 resonate at two adjacent frequencies, one frequency being slightly above the working frequency and one being slightly below. Thus, at the working frequency there is a phase difference between the orthogonal modes of operation. If this difference is 90 degrees, the antenna 10 will generate circular polarization. The spacing between the frequencies is preferably approximately the same as the bandwidth of each mode in order to have circular polarization with a good axial ratio and moderate bandwidth.

The gap or distance D between the conducting sheets 12, 14 is preferably approximately 0.1 wavelength. However, the gap may range from 0.01 to 0.25 wavelength. The wider the gap the wider the bandwidth of the antenna 10. The gap need not be constant everywhere between the two plates. Flaring open the two plates at their edges (not shown) functions to increase the bandwidth of the antenna. An advantage of the antenna 10 is that it is simple to manufacture (e.g., only two rectangular plates are required) and does not require a ground plane since it acts as a balanced system.

For the parallel plate antenna 10 each mode may be considered as a parallel RLC circuit with R being the radiation resistance and LC governing the resonance frequency and the Q factor (i.e., bandwidth). When the driving point Vin 16 of the antenna is placed at a corner, both modes are excited. The equivalent circuit is two parallel RLC circuits connected in series which resonate at adjacent frequencies. At the average of the two frequencies there exists a 90 degree phase shift between the circuits. Since both modes radiate energy in orthogonal polarization, but with a 90 degree phase difference, circular polarization is achieved. The antenna 10 is impedance matched to the feed line with a matching circuit (not shown) in order to minimize losses due to impedance mismatch.

Figure 2:
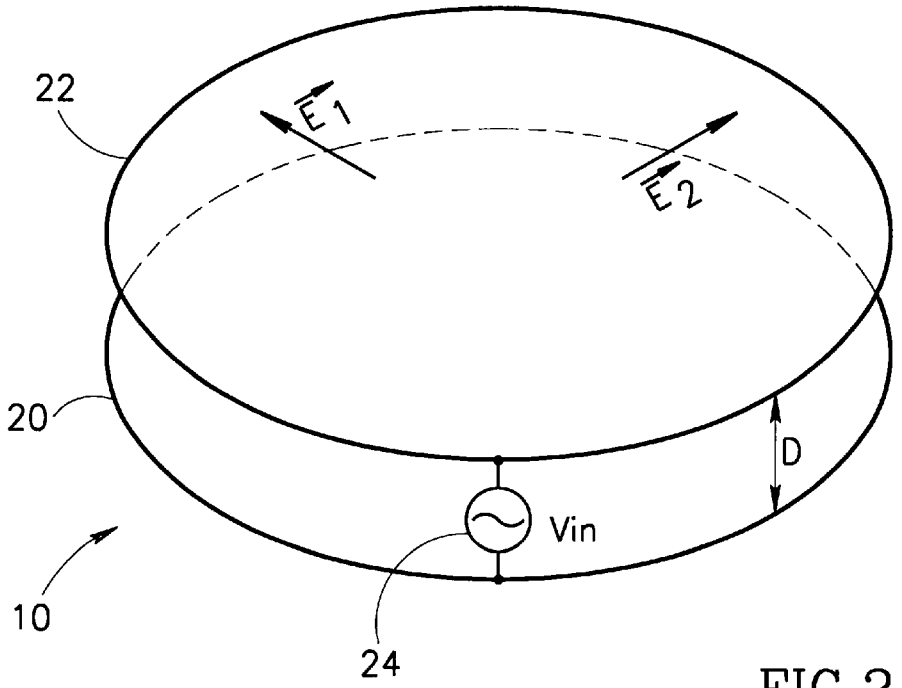
FIG. 2 illustrates a circularly shaped antenna constructed in accordance with a second embodiment of the present invention.

In general, the shape of the parallel plates may be any shape as long as there are modes of radiation at adjacent frequencies. Thus, the plates of the antenna may be rounded at the edges or perhaps elliptical. An illustration of a circularly shaped antenna constructed in accordance with a second embodiment of the present invention is shown in FIG. 2. The antenna 10 in this embodiment is constructed from two equal sized circularly shaped conductive plates 20, 22. The two plates are placed parallel with each other and separated by a gap or distance D. Input signal source Vin 24 can be placed anywhere around the perimeter of the circular plates 20, 22. The description of the operation of the antenna of this embodiment is similar to that for the antenna of the preferred embodiment presented above.

Figure 3:
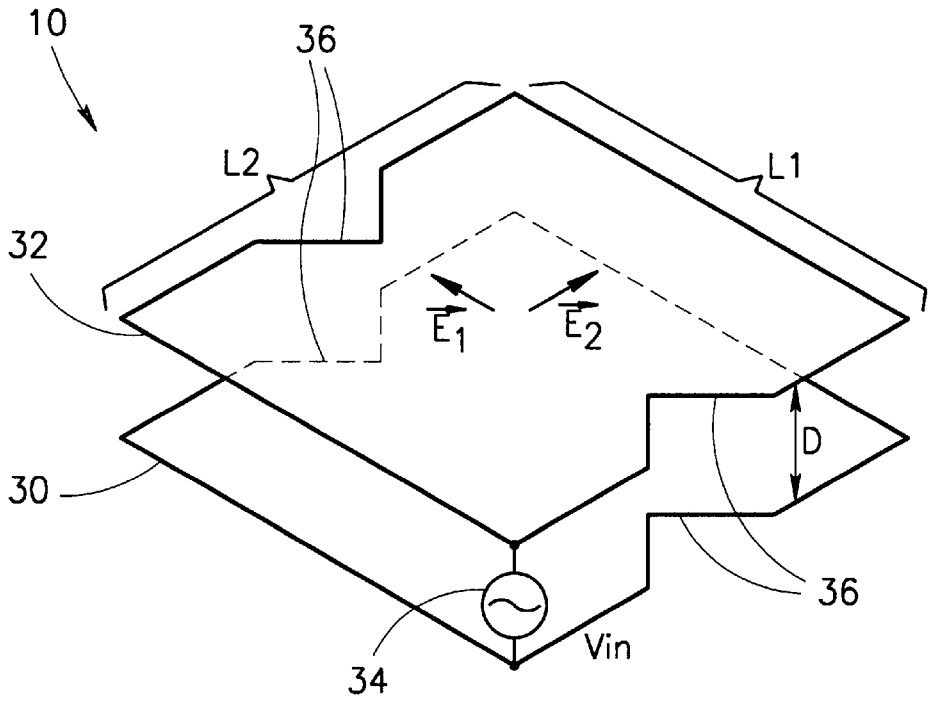
FIG. 3 illustrates a substantially rectangularly shaped antenna having cutouts constructed in accordance with a third embodiment of the present invention.

In addition, the shape of the antenna may have cutouts or strips added to the sides of the parallel plates in order to attain the required resonance frequency for each mode. Cutouts from the conductive sheet, for example, function to increase the resonance frequency. An illustration of a substantially rectangularly shaped antenna having cutouts constructed in accordance with a third embodiment of the present invention is shown in FIG. 3. The antenna 10 of this embodiment comprises two rectangularly shaped conductive plates 30, 32 having dimensions L1, L2 and separated a distance D from each other. The rectangle is nearly a square with one dimension slightly larger than the other. The side dimensions L1, L2 are nearly half a wavelength of the center frequency of the antenna 10. The plates are placed in parallel with each other and each plate 30, 32 has two cutouts 36 on both sides of one of the dimensions. Input signal source Vin 34 is fed into the antenna at one of the corners.

Figure 4:
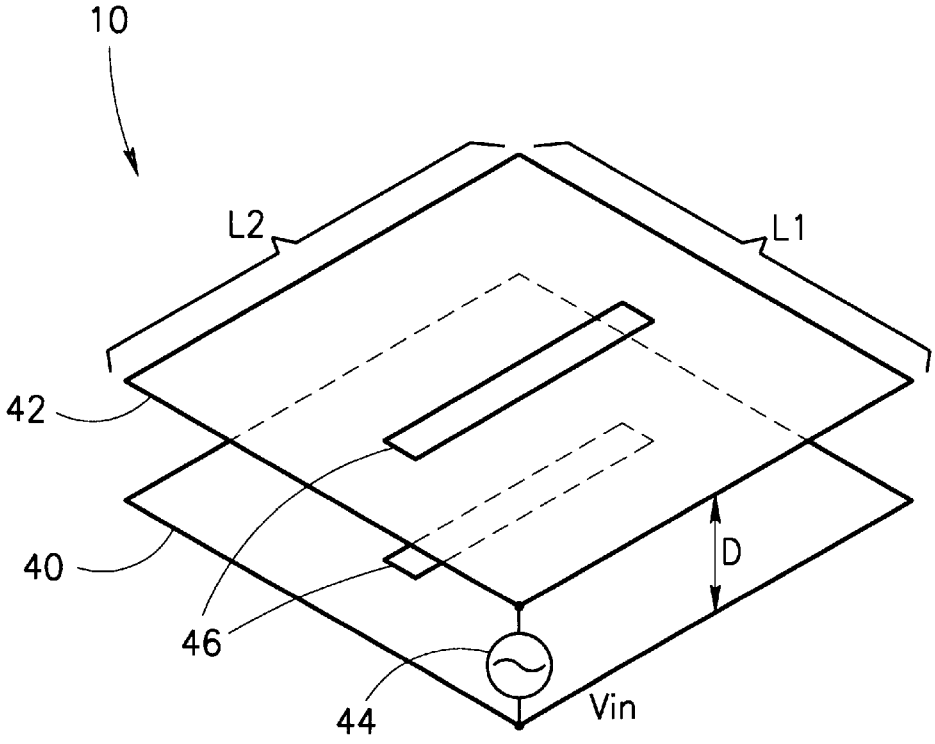
FIG. 4 illustrates a rectangularly shaped antenna having transverse slot cut outs constructed in accordance with a fourth embodiment of the present invention.

Further, the shape of the antenna may be slotted within the conductive plates. Alternatively, the antenna may have metal posts connecting the conductive plates together. A transverse slot cut out of the conductive plates, for example, functions to decrease the resonance frequency of the mode because it serves to add inductance to the antenna. An illustration of a rectangularly shaped antenna having a transverse slot cut out constructed in accordance with a fourth embodiment of the present invention is shown in FIG. 4.

The antenna 10 comprises two equal sized rectangularly shaped conductive plates 40, 42 having dimensions L1, L2 and separated by a distance D. The rectangle is nearly a square with one dimension slightly larger than the other. The side dimensions L1, L2 are nearly half a wavelength of the center frequency of the antenna 10. The two conductive plates are placed in parallel with each other. Input signal source Vin 44 is fed to the antenna at one of the corners. In the center of each conductive plate 40, 42 is a rectangularly shaped slotted cut out 46 which serves to decrease the resonance frequency of the antenna.

Figure 5:
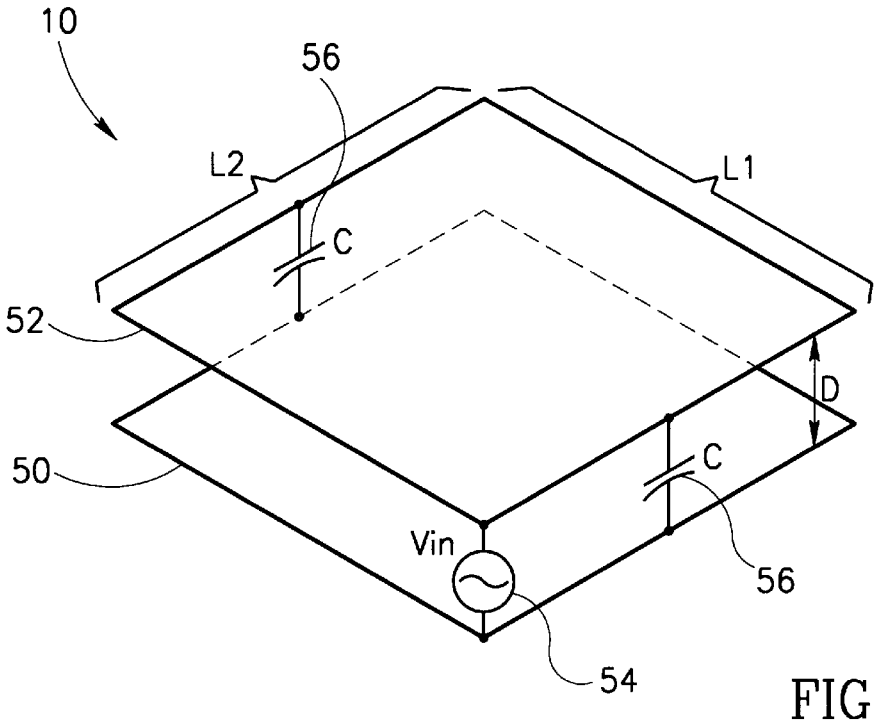
FIG. 5 illustrates a rectangularly shaped antenna having discrete components constructed in accordance with a fifth embodiment of the present invention.

The antenna may also comprise one or more discrete components such as capacitors or inductors. The capacitors and inductors are used to aid the antenna in achieving a desired resonance frequency. Discrete components would be useful, for example, if the physical dimensions of the antenna are relatively small and the related resonance frequency is high. Adding capacitance between the conductive plates of the antenna at one edge functions to effectively add length to the antenna thus lowering the resonance frequency. An illustration of a rectangularly shaped antenna having discrete components constructed in accordance with a fifth embodiment of the present invention is shown in FIG. 5.

Antenna 10 in this embodiment comprises two equal sized rectangularly shaped conductive plates 50, 52 having dimensions L1, L2 and separated by a distance D. The rectangle is nearly a square with one dimension slightly larger than the other. The side dimensions L1, L2 are nearly half a wavelength of the center frequency of the antenna 10. The two conductive plates are placed in parallel with each other. Input signal source Vin 54 is fed to the antenna at one of the corners. Two discrete capacitors 56 are electrically connected between both conductive plates 50, 52.

Figure 6:
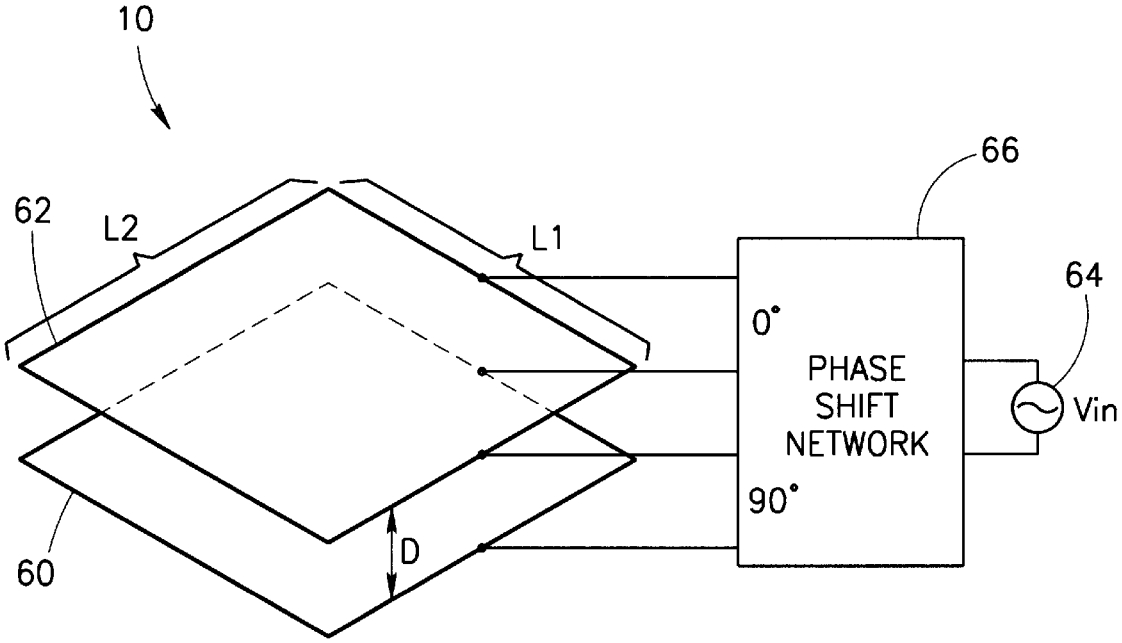
FIG. 6 illustrates a rectangularly shaped antenna having two feed points constructed in accordance with a sixth embodiment of the present invention.

Alternatively, the antenna may be driven with two feed points rather than just one. Each feed point is associated with one of the two modes. A 90 degree phase shifting network is utilized to achieve circular polarization. Constructing an antenna in this manner produces wider bandwidth due to the fact that the 90 degree phase difference is kept nearly constant over a wider bandwidth. An illustration of a rectangularly shaped antenna having two feed points constructed in accordance with a sixth embodiment of the present invention is shown in FIG. 6.

The antenna of this embodiment comprises two equal sized rectangularly shaped conductive plates 60, 62 having dimensions L1, L2 and separated by a distance D. The rectangle is nearly a square with one dimension slightly larger than the other. The side dimensions L1, L2 are nearly half a wavelength of the center frequency of the antenna 10. The two conductive plates are placed in parallel with each other. Input signal source Vin 64 is coupled to a phase shift network 66 which functions to generate two signals, the input signal not shifted and the input signal shifted by 90 degrees. Both outputs of the phase shift network 66 are fed to the antenna not on the same side but on adjacent sides as shown in FIG. 6.

The antenna of the present invention can also function as a diverse antenna in order to further enhance reception quality. Diversity entails employing two or more independent channels for receiving a signal in a multipath and/or interference environment. The different channels have different antennas positioned in various configurations. The different signal each configuration produces can be measured and the resulting information used to achieve the optimum reception. The system coupled to such a diverse antenna can make a decision regarding which channel has the highest SNR and/or SIR and consequently select the appropriate channel. Alternatively, the signals from all the separate channels can be combined using appropriate weights in accordance with likelihood ratios.

Diverse systems present a good solution where there is a problem of multipath attenuation. Multipath manifests itself as large differences in signal strength within a relatively small area. Local nullings in the signal strength can be avoided using a diverse system because usually one of the other antennas, positioned nearby, is out of the null. Nulling of the signal is an extremely local phenomena and is likely to effect separate antennas differently.

Diversity can take the form of space diversity, polarization diversity and pattern diversity. In the antenna of the present invention it is possible to achieve polarization diversity by placing two signal ports at two adjacent corners of the parallel plate antenna. Thus, each separate port excites the antenna in the same manner but with opposite senses of circular polarization. The excitations are orthogonal to one another and can be viewed as separate antennas. An illustration of a rectangularly shaped diverse antenna having two receiving ports constructed in accordance with a seventh embodiment of the present invention is shown in FIG. 7.

The antenna of this embodiment comprises two equal sized rectangularly shaped conductive plates 70, 72 having dimensions L1, L2 and separated by a distance D. The rectangle is nearly a square with one dimension slightly larger than the other. The side dimensions L1, L2 are nearly half a wavelength of the center frequency of the antenna 10. The two conductive plates are placed in parallel with each other. Two receiving ports Vin1 74 and Vin2 76 are placed on the antenna at adjacent corners as shown in FIG. 7. As stated above, receiving the antenna signal at two adjacent corners achieves polarization diversity.

Figure 7:
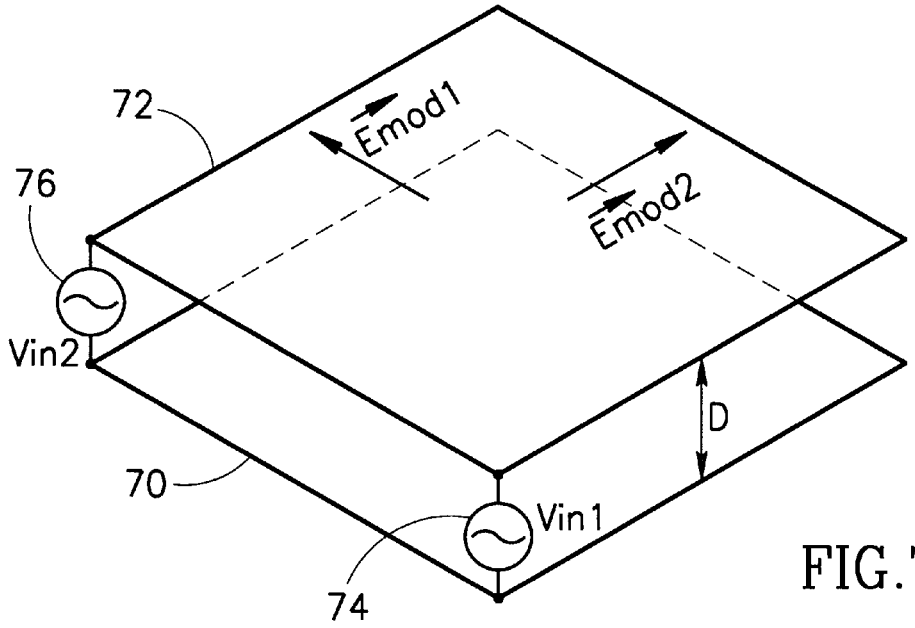
FIG. 7 illustrates a rectangularly shaped diverse antenna having two input ports constructed in accordance with a seventh embodiment of the present invention.

If the antenna of FIG. 7 is to be used as a transmitting antenna, the input signal source would be fed to only one of the two adjacent corner feed points at a time.

Figure 8:
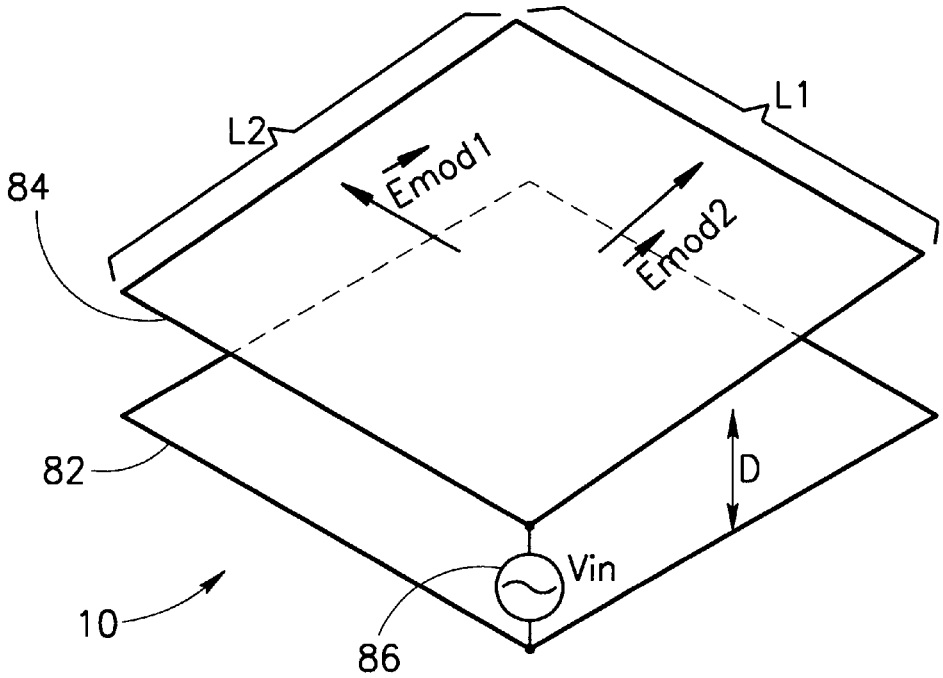
FIG. 8 illustrates a rectangularly shaped antenna having flared edges constructed in accordance with an eight embodiment of the present invention.

An illustration of an antenna constructed in accordance with an eight embodiment of the present invention is shown in FIG. 8. The antenna of the present invention, generally referenced 10, is mainly comprised of two equal size substantially rectangular shaped plates 82, 84 that are flared at their edges, have dimensions L1 by L2 and are placed apart from each other such that the two plates are flared in relations to each other. As shown in FIG. 8, the distance D between the two plates varies from one edge to another.

The rectangular plates 82, 84 are constructed from conductive sheets. The side dimensions L1, L2 are nearly half a wavelength of the center frequency of the antenna 10. Each rectangularly shaped plate nearly forms a square with one dimension, i.e., L1 or L2, slightly larger than the other. The signal source 86 functions as the input feed source to the antenna. The feed point of the input signal source 86 is at one of the corners of the antenna.

Due to the slightly different side dimensions, the parallel plates 82, 84 resonate at two adjacent frequencies, one frequency being slightly above the working frequency and one being slightly below. Thus, at the working frequency there is a phase difference between the orthogonal modes of operation. If this difference is 90 degrees, the antenna 10 will generate circular polarization. The spacing between the frequencies is preferably approximately the same as the bandwidth of each mode in order to have circular polarization with a good axial ratio and moderate bandwidth.

As stated above, the gap or distance D between the conducting sheets 82, 84 preferably ranges from 0.01 to 0.25 wavelength. The gap is not constant everywhere between the two plates. The flaring of the two plates at their edges functions to increase the bandwidth of the antenna. An advantage of the antenna 10 is that it is simple to manufacture (e.g., only two rectangular plates are required) and does not require a ground plane since it acts as a balanced system.

Figure 9:
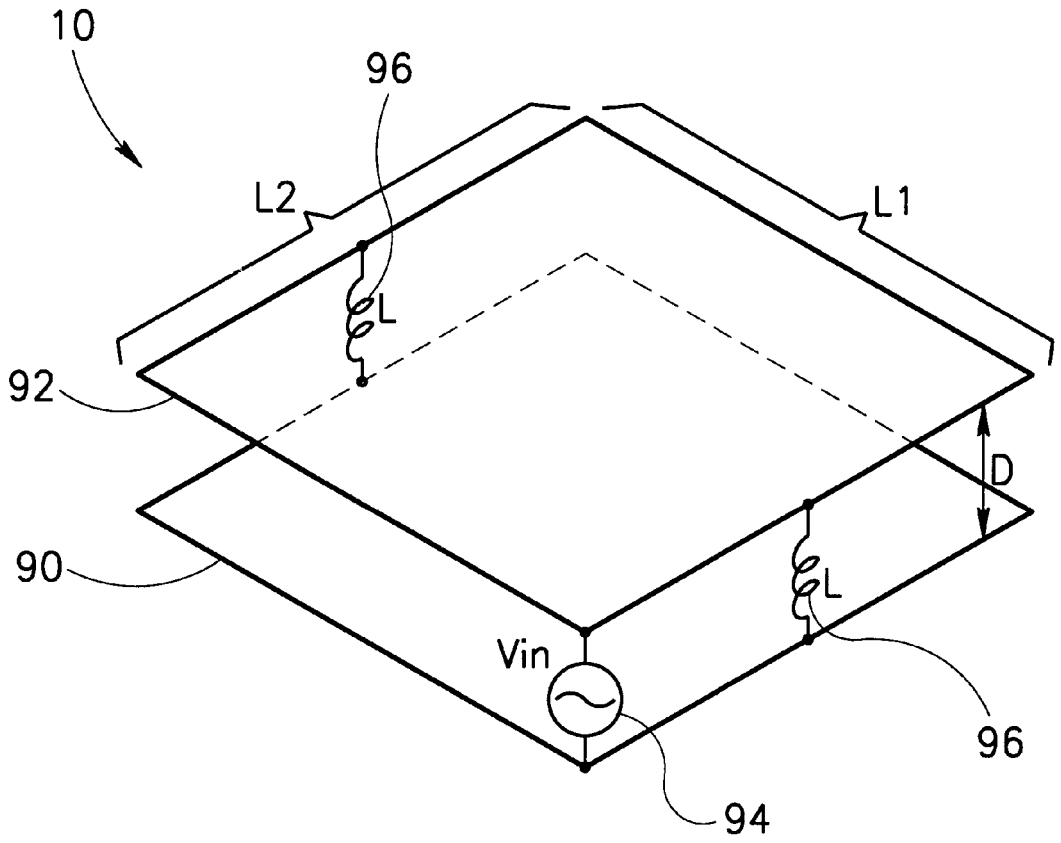
FIG. 9 illustrates a rectangularly shaped antenna having discrete components constructed in accordance with a ninth embodiment of the present invention.

An illustration of a rectangularly shaped antenna having discrete inductor components constructed in accordance with a ninth embodiment of the present invention is shown in FIG. 9.

Antenna 10 in this embodiment comprises two equal sized rectangularly shaped conductive plates 90, 92 having dimensions L1, L2 and separated by a distance D. The rectangle is nearly a square with one dimension slightly larger than the other. The side dimensions L1, L2 are nearly half a wavelength of the center frequency of the antenna 10. The two conductive plates are placed in parallel with each other. Input signal source Vin 94 is fed to the antenna at one of the corners. Two discrete indictors 96 are electrically connected between both conductive plates 90, 92.

While the invention has been described with respect to a limited number of embodiments, it will be appreciated that many variations, modifications and other applications of the invention may be made.

What is claimed is:

1. An RF antenna having a center frequency, comprising:

two substantially rectangularly shaped conductive plates separated by air, each said conductive plate having the dimensions L1 and L2 which are approximately a half wavelength of the center frequency, said conductive plates positioned at a distance D from each other, the dimension L1 of said conductive plates being slightly larger than the dimension L2;

feed points located at similar corners of said conductive plates, said input signal source electrically coupled across said feed points; and wherein the dimensions L1 aid L2 of said conductive plates are such that said antenna resonates in two adjacent frequencies, one frequency slightly above the center frequency and the other frequency slightly below the center frequency thereby creating a substantially 90 degree phase difference between orthogonal modes of operation resulting in the generation of circular polarization.

2. The RF antenna according to claim 1, wherein the distance between said adjacent frequencies is approximately the same as the bandwidth of said orthogonal modes of operation.

3. The RF antenna according to claim 1, wherein the distance D between said conductive plates is in the range from 0.01 to 0.25 wavelength.

4. The RF antenna according to claim 1, wherein said conductive plates are positioned exactly parallel with each other.

5. The RF antenna according to claim 1, wherein said distance D between said conductive plates varies to produce a flaring open at the edges of said conductive plates.

6. The RF antenna according to claim 1, wherein said conductive plates comprise cutouts in the sides to increase the resonance frequency of said antenna.

7. The RF antenna according to claim 1, wherein said conductive plates comprise slot cut outs to decrease the resonance frequency of the mode of said antenna.

8. The RF antenna according to claim 1, further comprising at least one discrete component electrically coupled between said conductive plates.

9. The RF antenna according to claim 8, wherein said at least one discrete component comprises a capacitor.

10. The RF antenna according to claim 8, wherein said at least one discrete component comprises an inductor.

11. The RF antenna according to claim 1, wherein said two rectangularly shaped conductive plates are substantially equal in size.

12. An RF antenna having a center frequency, comprising:

two substantially rectangularly shaped conductive plates separated by air, each said conductive plate having the dimensions L1 and L2 which are approximately a half wavelength of the center frequency, said conductive plates positioned at a distance D from each other, the dimension L1 of said conductive plates being slightly larger than the dimension L2;

first feed points located on similar first sides of said conductive plates having dimension L1;

second feed points located on similar second sides of said conductive plates having dimension L2, said second side adjacent to said first side;

a phase shift network having an input, a first output and a second output, said input electrically coupled to a single input signal source, said first output electrically coupled across said first feed points, said second output electrically coupled across said second feed points; and wherein the dimensions L1 and L2 of said conductive plates are such that said antenna resonates in two adjacent frequencies, one frequency slightly above and the center frequency and the other frequency slightly below the center frequency thereby creating a substantially 90 degree phase difference between orthogonal modes of operation resulting in the generation of circular polarization.

13. The RF antenna according to claim 12, wherein said two rectangularly shaped conductive plates are substantially equal in size.

14. An RF antenna having a center frequency comprising:

two substantially circularly shaped conductive plates separated by air, said conductive plates positioned at a distance D from each other;

feed points located at similar locations on the perimeter of said conductive plates, said input signal source electrically coupled across said feed points; and wherein said conductive plates have dimensions and are positioned such that they resonate in two adjacent frequencies, one frequency slightly above and the center frequency and the other frequency slightly below the center frequency thereby creating a substantially 90 degree phase differences between orthogonal modes of operation resulting in the generation of circular polarization.

15. The RF antenna according to claim 14, wherein said two circularly shaped conductive plates are substantially equal in size.

16. An RF antenna having polarization diversity and a center frequency, comprising:

two substantially rectangularly shaped conductive plates separated by air, each said conductive plate having the dimensions L1 and L2 which are approximately a half wavelength of the center frequency, said conductive plates positioned at a distance D from each other, the dimension L1 of said conductive plates being slightly larger than the dimension L2;

first feed points located at a similar first corner of said conductive plates, said first input signal source electrically coupled across said first feed points;

second feed points located at a similar second corner of said conductive plates, said second input signal source electrically coupled across said first feed points, said second corner being adjacent to said first corner;

wherein the dimensions L1 and L2 of said conductive plates are such that said antenna resonates in two adjacent frequencies, one frequency slightly above and the center frequency and the other frequency slightly below the center frequency thereby creating a substantially 90 degree phase difference between orthogonal modes of operation resulting in the generation of circular polarization; and wherein said first feed points and said second feed points function to create polarization diversity, said first input signal source and said second input source exciting said antenna in substantially the same manner but with opposite senses of circular polarization orthogonal to one another.

17. The RF antenna according to claim 16, wherein said two rectangularly shaped conductive plates are substantially equal in size.

* * * * *